US006854587B2

(12) United States Patent
Handel et al.

(10) Patent No.: US 6,854,587 B2
(45) Date of Patent: Feb. 15, 2005

(54) METHOD AND APPARATUS FOR PACKAGING TAMALES

(75) Inventors: Gary A. Handel, Austin, MN (US); Jeffrey J. Morrison, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 35 days.

(21) Appl. No.: 10/272,668

(22) Filed: Oct. 16, 2002

(65) Prior Publication Data

US 2003/0046898 A1 Mar. 13, 2003

Related U.S. Application Data

(62) Division of application No. 09/919,485, filed on Jul. 31, 2001, now Pat. No. 6,546,697.

(51) Int. Cl.[7] ..... B65G 47/26
(52) U.S. Cl. ..... 198/457.07; 198/598; 198/441
(58) Field of Search ..... 198/441, 456, 198/457.07, 598

(56) References Cited

U.S. PATENT DOCUMENTS

| | | | | | |
|---|---|---|---|---|---|
| 1,790,404 | A | * | 1/1931 | Bronander | 198/441 |
| 2,835,375 | A | * | 5/1958 | McGihon | 198/441 |
| 3,250,372 | A | * | 5/1966 | Wagner et al. | 198/396 |
| 3,425,184 | A | | 2/1969 | Heliot | 414/798.2 |
| 3,512,336 | A | | 5/1970 | Rosecrans | 198/435 |
| 3,967,717 | A | * | 7/1976 | Bauer | 198/441 |
| 4,057,138 | A | * | 11/1977 | Grebe | 198/370.08 |
| 4,386,490 | A | | 6/1983 | Griffith et al. | 53/148 |
| 4,398,383 | A | | 8/1983 | Prakken | 53/537 |
| 4,498,576 | A | * | 2/1985 | Anderson | 198/426 |
| 4,541,532 | A | * | 9/1985 | Wilson | 209/651 |
| 4,564,105 | A | * | 1/1986 | Brouwer et al. | 198/457.07 |
| 4,699,275 | A | * | 10/1987 | Holsonbake | 209/616 |
| 4,804,076 | A | * | 2/1989 | Pace | 198/475.1 |
| 4,864,801 | A | | 9/1989 | Fallas | 53/446 |
| 5,099,634 | A | | 3/1992 | Treloar | 53/244 |
| 5,454,212 | A | | 10/1995 | Tanaka | 53/473 |
| 5,579,895 | A | | 12/1996 | Davis, Jr. et al. | 198/456 |
| 5,588,285 | A | | 12/1996 | Odenthal | 53/171 |
| 5,778,640 | A | | 7/1998 | Prakken et al. | 53/475 |
| 6,041,910 | A | * | 3/2000 | Avery et al. | 198/370.07 |
| 6,158,735 | A | * | 12/2000 | Cote et al. | 271/302 |
| D487,099 | S | * | 2/2004 | Bruns et al. | D15/28 |

* cited by examiner

*Primary Examiner*—Richard Ridley
(74) *Attorney, Agent, or Firm*—IPLM Group, P.A.

(57) ABSTRACT

A tamale loading apparatus (10) includes a converging mechanism (61) and diverter wheels (83, 84) to position tamales (200) on a belt (24). The belt is run at a speed to fly the tamales (200) into a can (300) wherein the tamales are automatically loaded and it is no longer necessary to load the tamales (200) by hand into the cans (300).

5 Claims, 13 Drawing Sheets

2 of 124
300
300
300
125
118d
118c
118b
118a
118e
132
132
121
129
127
128a
127b
127a
129b
129
128b
128

SECTION B-B 118h
118f
118g
118m
148
147
146
145

150
151
149
118b
135
152
141
143
142
141
135
118a
118e
118j

METHOD AND APPARATUS FOR PACKAGING TAMALES

This is a division application Ser. No. 09/919,485, filed Jul. 31, 2001, now U.S. Pat. No. 6,546,697.

BACKGROUND OF THE INVENTION

1. Field of the Invention

This invention relates generally to the packaging of tamales and more particularly to the automated and high speed packaging of tamales.

2. Description of the Prior Art

Tamales are a meat product wrapped in corn meal which is then wrapped with a fine paper. The tamales are very fragile. They are soft and frangible. To date, the packaging of tamales has always been by hand. Tamales are placed on a loading conveyor, usually in groups of three. Individual workers are stationed along the length of the conveyor. The workers will make a sweeping motion to take three tamales at once and then place then into a can. A second set of three is similarly taken by the worker and placed in the same can. The can, with six tamales, is then transported to another area where it is filled with sauce and further packaging steps are completed, i.e., putting on a lid, etc.

To date, there have not been many successful attempts in automating this process. It is a very labor-intensive process and adds substantially to the costs. In addition, as the workers grab the tamales, the shape of the tamale is effected. That is, the tamales are quite soft and the finger indentation of the worker grasping the tamales to place them in the can may be left on the tamales.

The present invention addresses the problems associated with the prior art and provides for an automated high speed loading of tamales that does not involve hand packing.

SUMMARY OF THE INVENTION

In one embodiment, the invention is an apparatus for positioning frangible objects on a moving conveyor from a first position to a second position. The apparatus includes a conveyor having a conveyor belt for carrying the frangible objects. The conveyor belt has a centerline. A first rotatable wheel is mounted above the conveyor belt. The wheel has a plurality of pushing members attached to the wheel at spaced intervals. The wheel has an axis which is at an angle to the centerline of the conveyor belt. A stop is positioned laterally to the frangible objects when in the first position, wherein rotation of the wheel over the moving conveyor causes the paddles to contact the frangible objects at the first position and move the frangible objects laterally as the frangible objects continue travelling on the conveyor to contact the stop member, thereby moving the frangible objects to a second position.

In another embodiment, the invention is a method of positioning frangible objects moving on a conveyor. The method includes placing a frangible object on a moving conveyor, the frangible object being at a first lateral position. Then, a pushing member is moved in a path. The path is at an angle to the centerline of the conveyor, wherein the movement of the pushing member relative to the conveyor has a lateral component and a longitudinal component. Next, the frangible object is contacted with the moving/pushing member, wherein the frangible object is moved from the first lateral position to a second lateral position.

In another embodiment, the invention is a method of loading an object into a container. The method includes placing an object on a moving conveyor belt, the conveyor belt having a loading end. The container is then indexed to a receiving position, the container in alignment with the object and positioned at the loading end. The conveyor is moved at a speed sufficient to fly the object off of the conveyor into the container. Next, the container is indexed away from the conveyor.

In another embodiment, the invention is an apparatus for loading tamales into a container. The apparatus includes a frame and a conveyor operatively connected to the frame. The conveyor has a conveyor belt and drive mechanism for moving the conveyor belt. The conveyor belt has a longitudinal axis. The conveyor belt has a loading end and an unloading end. A means for positioning the conveyor at the loading end of the conveyor belt is provided. The positioning means positions the container for receiving the object as the object if thrown off of the conveyor belt and for removing the container after the container is filled.

BRIEF DESCRIPTION OF THE DRAWINGS

FIGS. 1*a* and 1*b* are perspective views of the tamale packaging apparatus of the present invention;

DETAILED DESCRIPTION OF THE PREFERRED EMBODIMENT

Figure 1A:
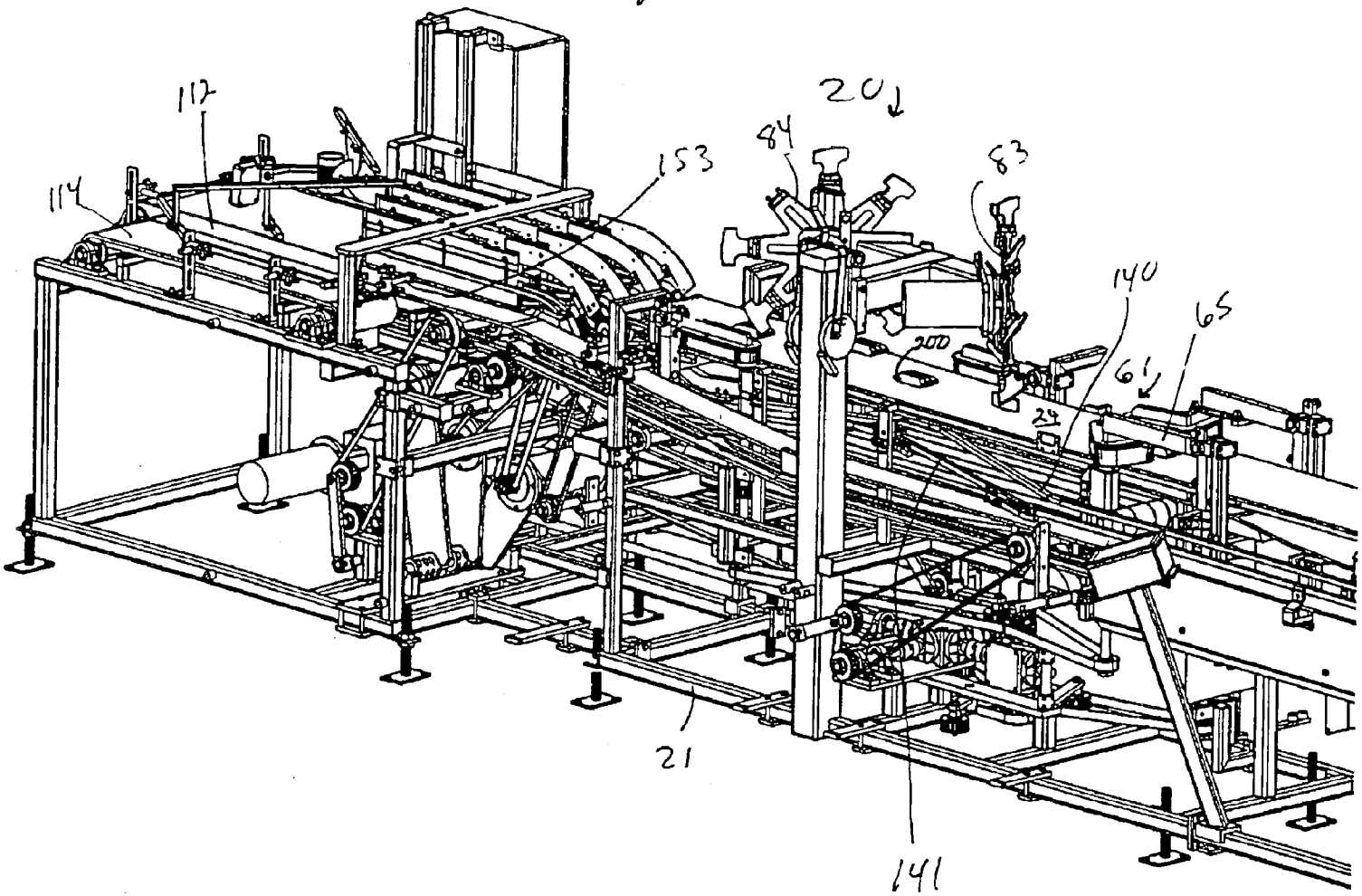
Figure 11B:
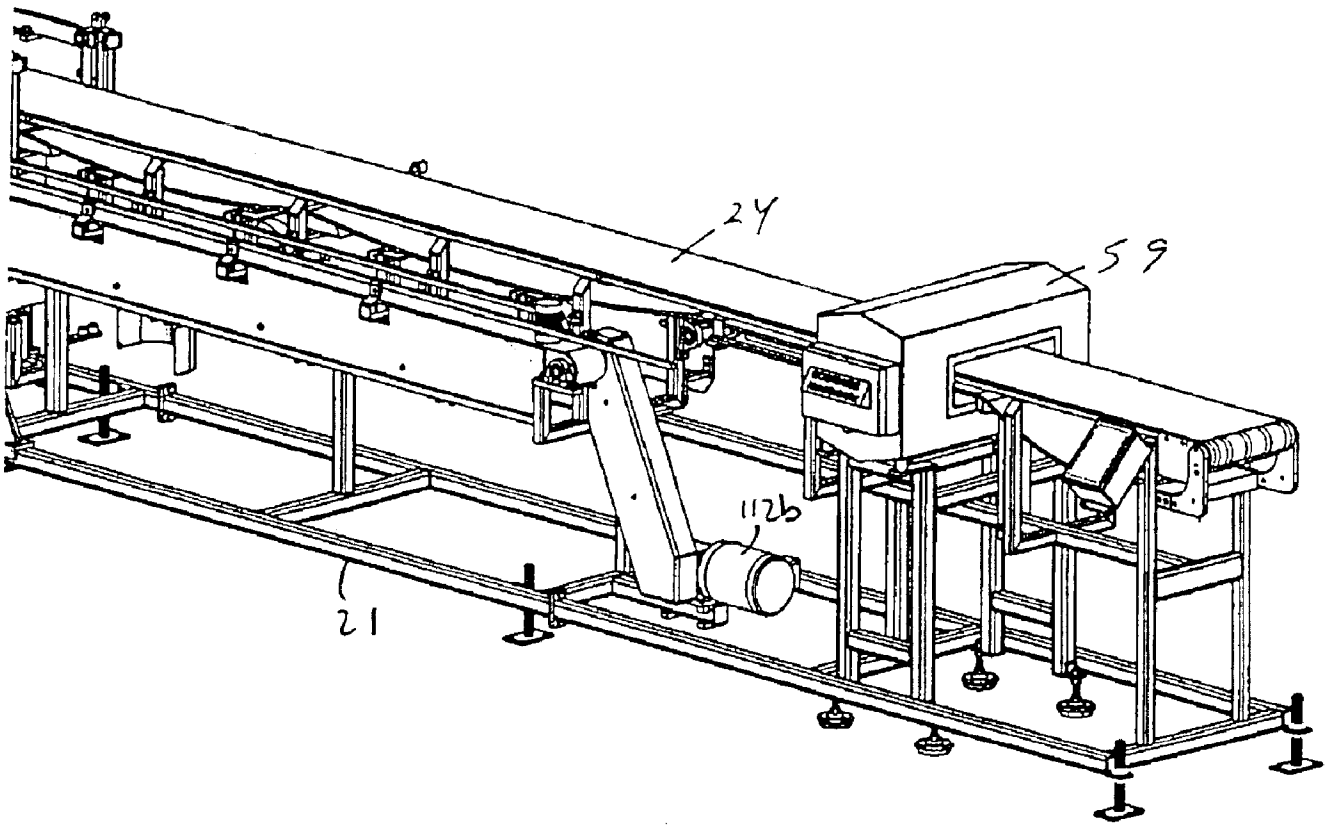
FIG. 11 is a perspective view of the strip off conveyor shown in FIG. 1*a*.

Referring to the drawings, wherein like numerals represent like parts throughout the several views, there is generally disclosed at 20 a tamale loading apparatus. In FIGS. 1*a* and 1*b*, there are some additional features shown, which have been removed in other views, for clarity and when not needed to understand the invention. The tamale loading apparatus 20 has a frame 21 on which the various components, to be described more fully hereafter, are mounted. The frame 21 includes a plurality of longitudinal, upright and cross members that are connected by suitable means such as welding or brackets, all means well known in the art. A plurality of leveling feet 22 are connected to the longitudinal members of the frame 21 in order to properly align the apparatus 20. A tamale transport conveyor 23 includes a continuous loop belt 24. The belt 24 is mounted on to end rollers 25, 26 which are in turn suitably mounted on the frame 21. Underneath the belt 24 is supported a solid plastic bearing member 27 that extends substantially between the end rollers 25, 26. The continuous loop belt 24 rests on the bearing member 27 as it is moved around the end rollers 25, 26.

Figure 4:
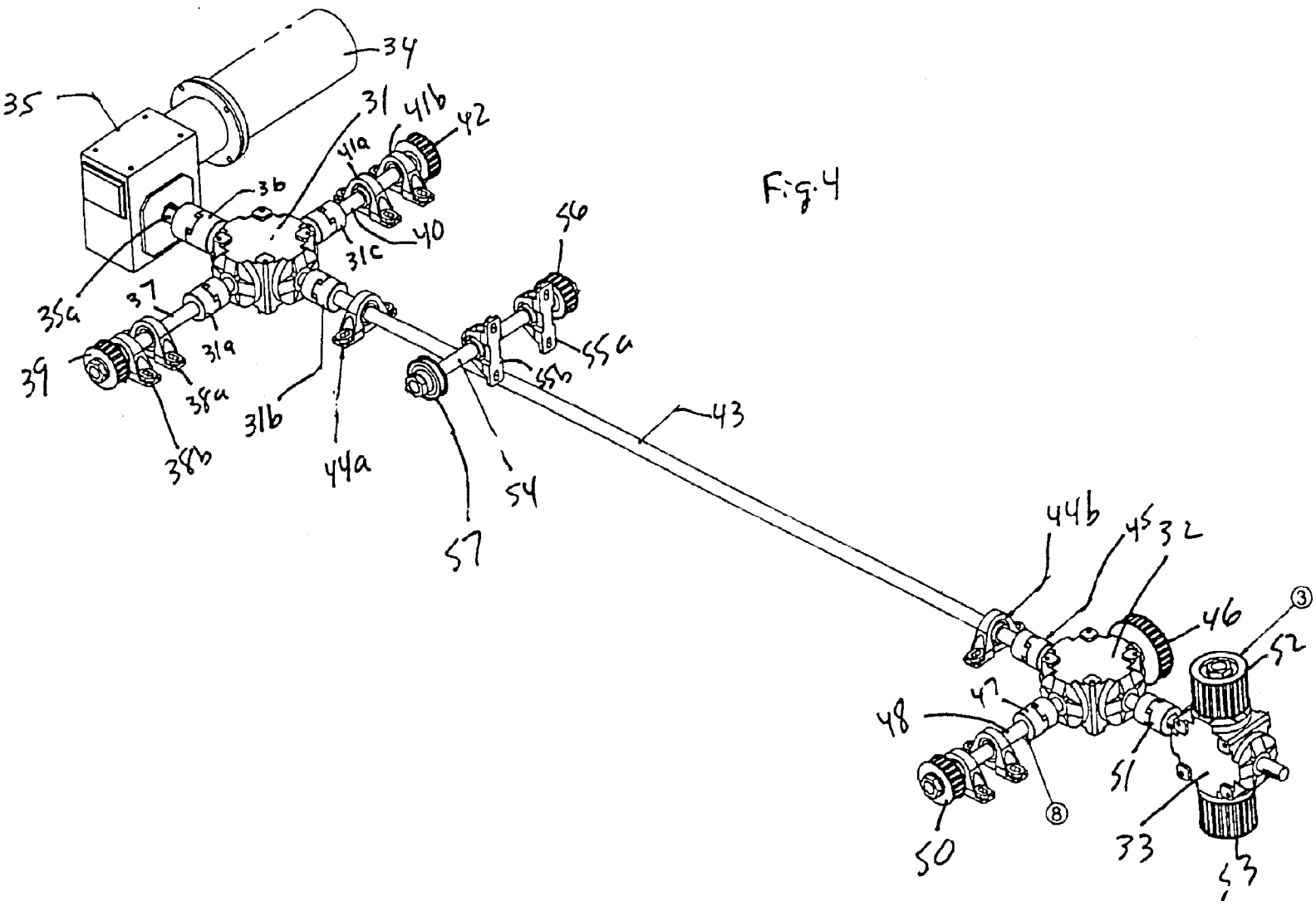
FIG. 4 is a perspective view of the drive train used in the tamale packaging apparatus shown in FIG. 1*a;*

The conveyor 23 is driven by a drive train, generally designated at 30 and is shown in FIG. 4. The drive train 30 includes a first gear box 31, second gear box 32 and third gear box 33. The gear boxes 31–33 are driven by a servo motor 34. The servo motor 34 is operatively connected to a gear coupler 35. The gear coupler 35 has an output shaft 35*a* which is operatively connected to a coupler 36. The coupler 36 is operatively connected to and drives the first gear box 31. The gear box 31 has three output shafts that are operatively connected to couplers 31*a*, 31*b*, 31*c*. Line shaft 37 is operatively connected to the coupler 31*a* and is supported by bearing blocks 38*a*, 38*b*. The other end of the line shaft 37 is operatively connected to a pulley 39. The coupler 31*c* is operatively connected to a line shaft 40 that is carried by bearing blocks 41*a*, 41*b*. The other end of the line shaft 40 is operatively connected to a pulley 42. The coupler 31*b* is operatively connected to a line shaft 43 that is carried by bearing blocks 44*a*, 44*b*. The other end of the line shaft 43 is operatively connected to a coupler 45 which is in turn connected to the input of the gear box 32. The gear box 32 has three output shafts. The first output shaft is directly connected to a pulley 46. The second output shaft is operatively connected to a coupler 47 which is operatively connected to a line shaft 48. The line shaft 48 is carried by block bearings 49*a*, 49*b*. The other end of the line shaft 48 is operatively connected to a pulley 50. The other output shaft of the gear box 32 is operatively connected to a coupler 51 which is operatively connected to the input shaft of the gear box 33. The gear box 33 has a first pulley 52 operatively connected to one of its output shafts and a second pulley 53 operatively connected to another of its output shafts. The drive train 30 is operatively connected to and supported by the frame 21. Also operatively connected to the frame 21, between the first gear box 31 and second gear box 32 is a line shaft 54. The line shaft 54 is carried by two block bearings 55*a*, 55*b* which are in turn operatively connected to the frame 21. Connected to one end of the line shaft 57 is a pulley 56 and at its other end is operatively connected a pulley 57.

The conveyor 23 is driven by a belt 58. The belt 58 is driven by pulley 57 at one end and is positioned around the roller 26 at its other end. The pulley 57 is driven by a belt 60 which is operatively connected between pulleys 56, 46. Positioned proximate a first end 23*a* of the conveyor 23 is a metal detector 59. The conveyor 23 passes through an opening of the metal detector 59.

Figure 2A:
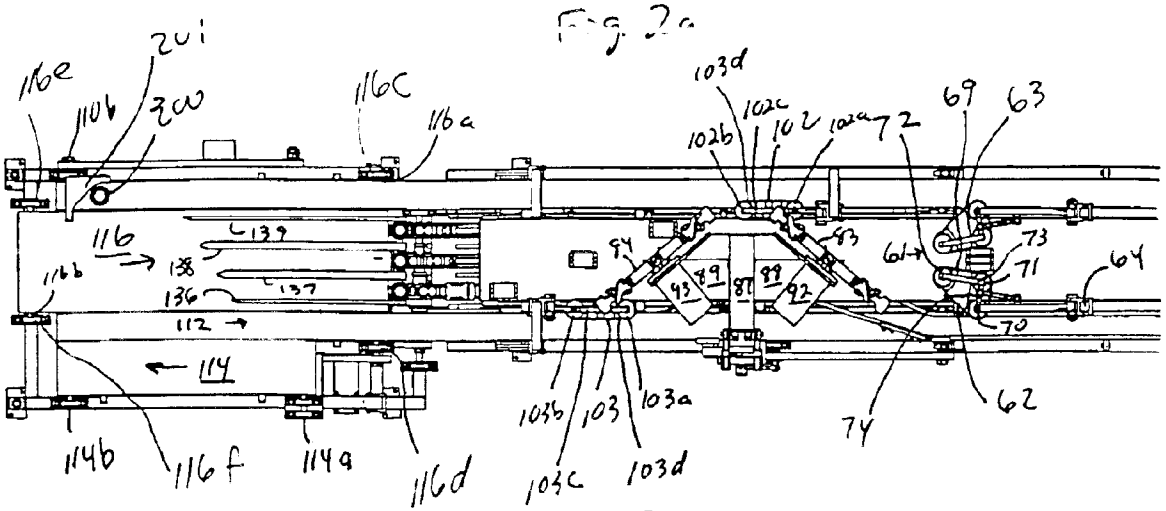
FIGS. 2*a* and 2*b* are top plan views of the tamale packaging apparatus shown in FIGS. 1*a* and 1*b;*
Figure 3A:
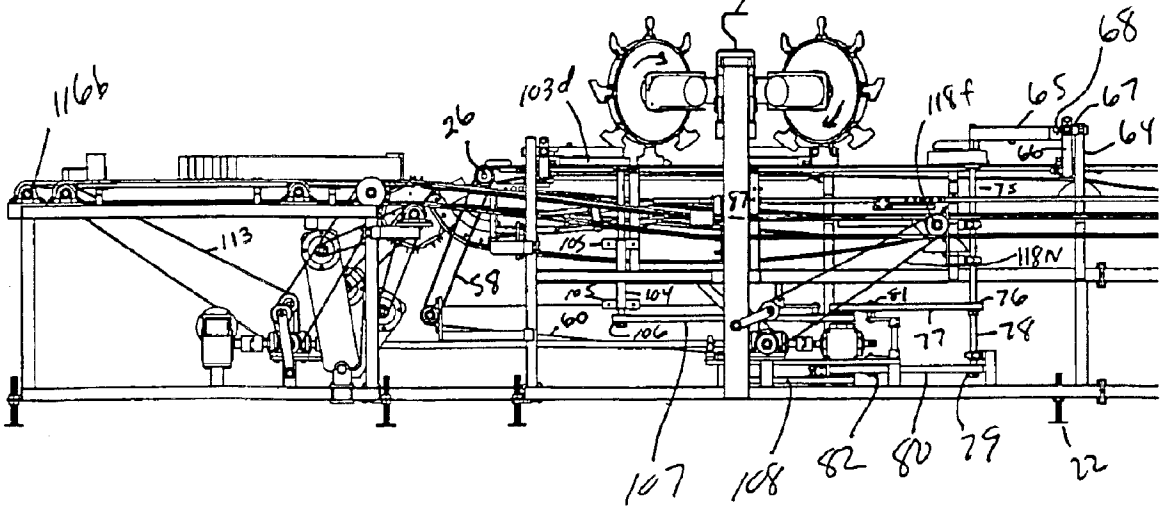
FIGS. 3*a* and 3*b* are side elevational views of the tamale packaging apparatus shown in FIGS. 1*a* and 1*b;*
Figure 2B:
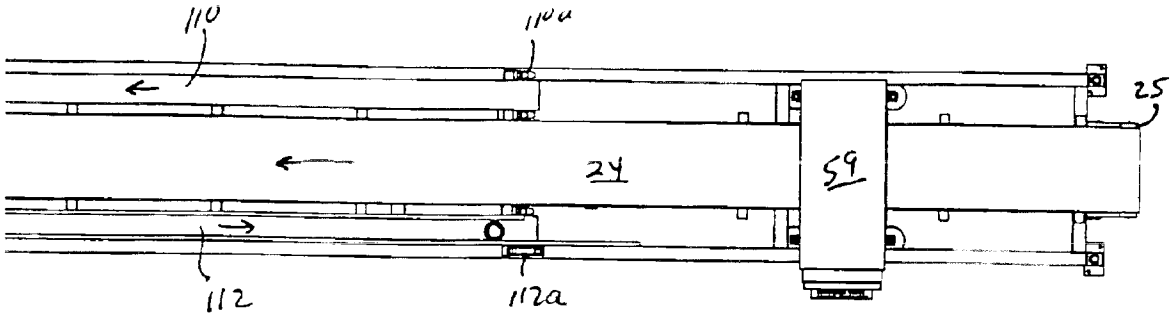
Figure 3B:
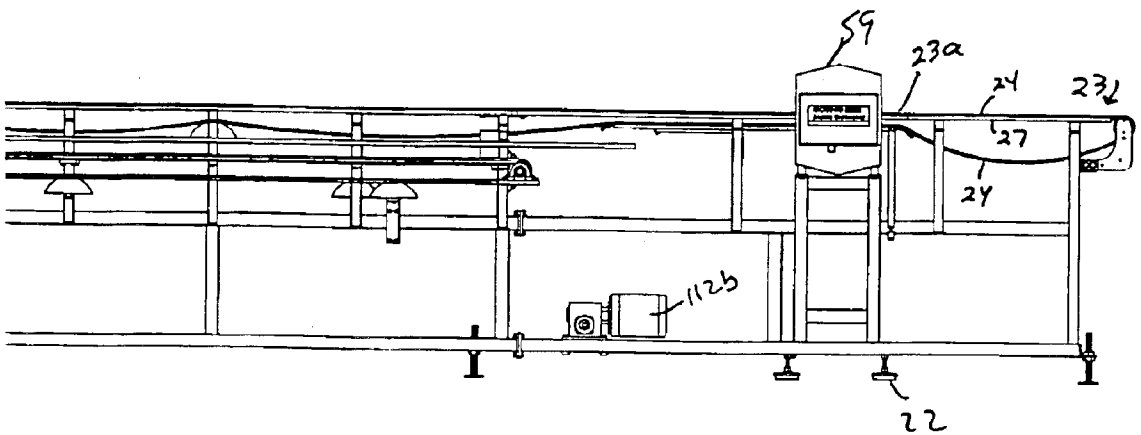

A converging mechanism, generally designated at 61, includes a first conveyor 62 laterally spaced from a second conveyor 63. The conveyors 62, 63 are mirror images of each other and only one will be described in detail. A post 64 is operatively connected to the frame 21. The post 64 has a parallel support member 66 operatively connected thereto by an arm 67. An extension arm 65 is pivotally connected to the support members 66 by a pivot joint 68, thereby allowing the extension arm to pivot upward, as viewed in FIG. 3*a*. A conveyor belt 69 is rotatably mounted around three rollers 70, 71, 72. The three rollers 70–72 are operatively connected to each other by suitable brackets that connect shafts about their centerline. As seen in FIG. 2*a*, the brackets are shown as reference numerals 73, 74. A drive shaft 75 has a drive sprocket (not shown) which is operatively connected to the roller 70, thereby providing a rotating force to the conveyor belt 69 as the roller 70 is driven. The drive shaft 75 has a pulley 76 operatively connected thereto. A drive belt 77 is positioned around the pulley 76 and pulley 52 to provide the driving force. A similar drive shaft 78 has a pulley 79 that is connected by a belt 80 to the pulley 53. As seen in FIG. 3*a*, the shaft 78 extends behind the drive shaft 75 up to the rollers in the second conveyor 63. A tensioning pulley 81 is positioned between the pulleys 76, 52. Similarly, a tensioning pulley 82 is positioned between the pulley 79 and pulley 53. The conveyor 62 is in the shape of a triangle. The side between roller 72 and 73 is at an angle to the centerline of the belt 24 to be angled inward downstream.

Two diverter wheels 83, 84 are mounted over the belt 24. An upright support member 85 is secured to the frame 21. Pivotally connected to the member 85 by a pivot joint 86 is a T-shaped support member 87 having a first arm 88 and a second arm 89. Servo motor mounting plate 90 is operatively connected to the first arm 88 and servo motor mounting plate 91 is operatively connected to the second arm 89. Servo motor 92 is mounted in the mounting plate 90 and has the diverter wheel 83 operatively connected to its output shaft. Similarly, servo motor 93 is mounted in the mounting plate 91 and its output shaft is operatively connected to the diverter wheel 84. The diverter wheels 83, 84 are similar in construction and therefore only one will be described in detail. The diverter wheels 83, 84 are the same, except for their alignment with respect to the conveyor 23.

The diverter wheel 84 has a central portion 94 in the shape of a disc with an outer rim 95 operatively connected to the central portion 94. A plurality of diverter paddles 96 are secured to the outer rim 95 by suitable means such as bolts 97. A shown in the Figures, there are eight diverter paddles 96 secured to the diverter wheel 84. It is understood that other numbers of paddles could be utilized as well as different constructions such as a spoke configuration.

A plane, extending through the diverter wheel 84 forms an angle of approximately 40 degrees with the longitudinal axis of the conveyor 23. The diverter paddles 96 have a tamale engaging surface 96*a* that is at an angle of 54 degrees to the plane extending through the diverter wheel 84. The specific angles of the diverter wheel 84 to the conveyor 23 and the angle of the diverter paddles 96 to the wheel 84 are determined so that the tamales 200 receive substantially only lateral forces from the diverter paddles 96 as they are moved laterally, as will be described in more detail hereafter. Similarly, the diverter wheel 83 has diverter paddles 98, having tamale-engaging surfaces 98*a* operatively connected thereto and is at an angle such that the tamale engaging surfaces 98*a* will push the tamales to the opposite side of the conveyor 23 than the tamale engaging surfaces 96*a*. The distance from the end of the engaging surfaces 96*a*, 98*a* to the center of their respective wheel is preferably at least 12 inches so that the movement of the surfaces proximate a straight line over the conveyor 23. The larger the distance the closer the path is to a straight line. It is also understood a reciprocating mechanism could also be used to move the tamales laterally. The reciprocating mechanism would be at an angle to have a lateral and longitudinal component, with respect to the conveyor, the same as the movement of the surfaces 96*a*, 98*a*.

Figure 5:
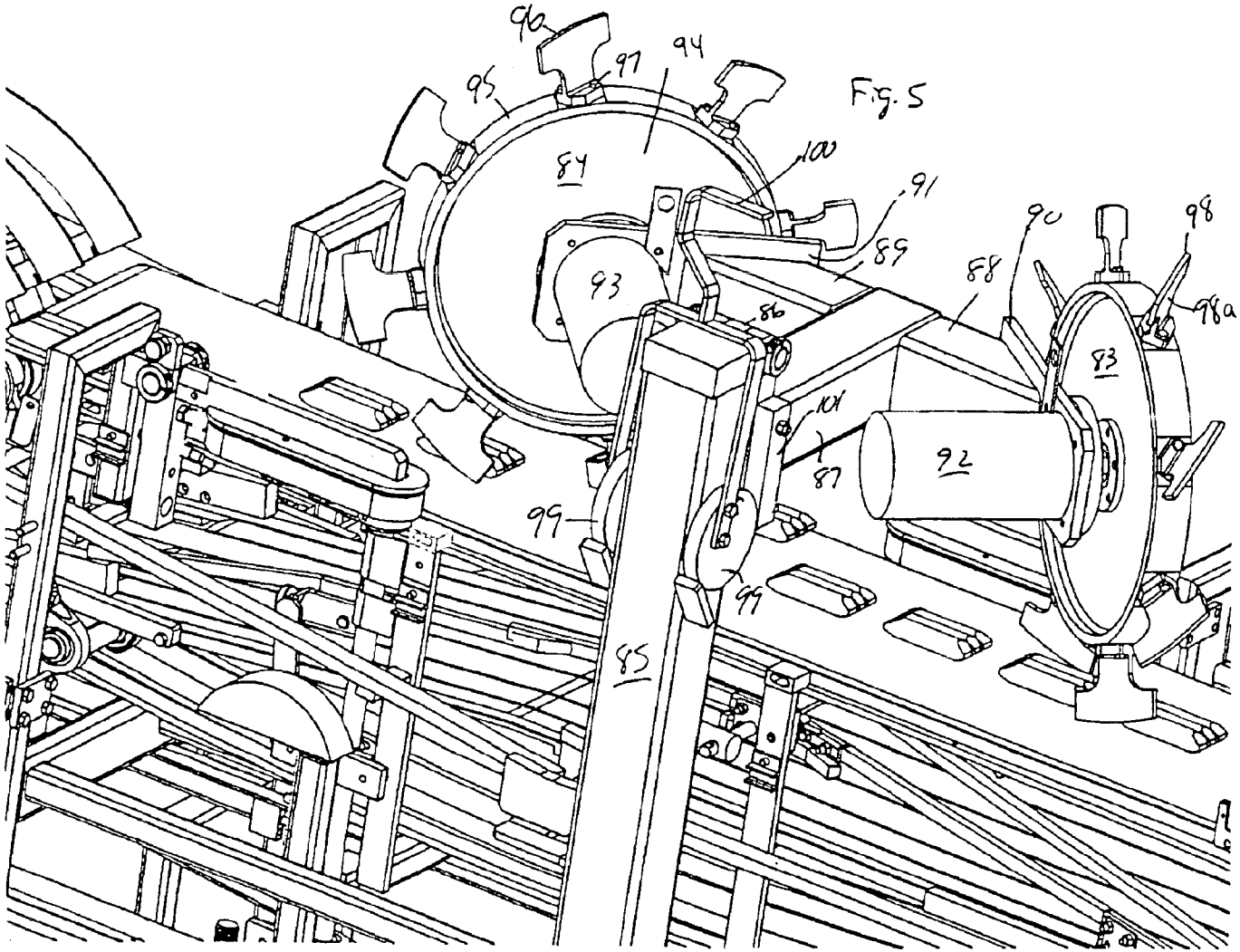
FIG. 5 is an enlarged perspective view showing the diverter wheels shown in FIG. 1*a;*

Two cam wheels 99 are rotatably mounted to the support member 85. A handle 100 is secured to the cam wheels 99. As seen in FIG. 5, pulling back on the handle 100 will cause the cam wheels 99 to rotate and the cams will engage stops 101, which are secured to the T-shape support member 87. This will cause the T-shaped support member 87 to pivot upward, thereby moving the diverter wheels 83, 84 out of position for cleaning or maintenance.

A side or positioning conveyor 102 is operatively mounted on the right side of the conveyor 23 and a side positioning conveyor 103 is operatively mounted to the left side of the conveyor 23. The side positioning conveyor 102 operates in conjunction with the diverting wheel 83 and the side positioning conveyor 103 operates in conjunction with the diverting wheel 84. The side positioning conveyor 102 is of similar construction to the side positioning conveyor 103. Each conveyor 102, 103 has a first roller 102*a*, 103*a* operatively connected to a second roller 102*b*, 103*b* by a bracket 102*c*, 103*c*. A conveyor belt 102*d*, 103*d* is positioned around the rollers for rotation about the rollers. The roller 103*a* is operatively connected to a drive shaft 104 that is mounted by suitable bearing blocks 105 and has a pulley 106 at its end. The pulley 106 is connected by belt 107 to pulley 52 to provide the rotating force for the conveyor belt 103*d*. Similarly, a similar drive shaft (hidden behind the post 87 in FIG. 3*a*), is connected to the roller 102*b*. The drive shaft (not shown) has a pulley (not shown) which is connected via a belt 108 to pulley 53, thereby providing the rotating force for the belt 102*d*.

Figure 11:
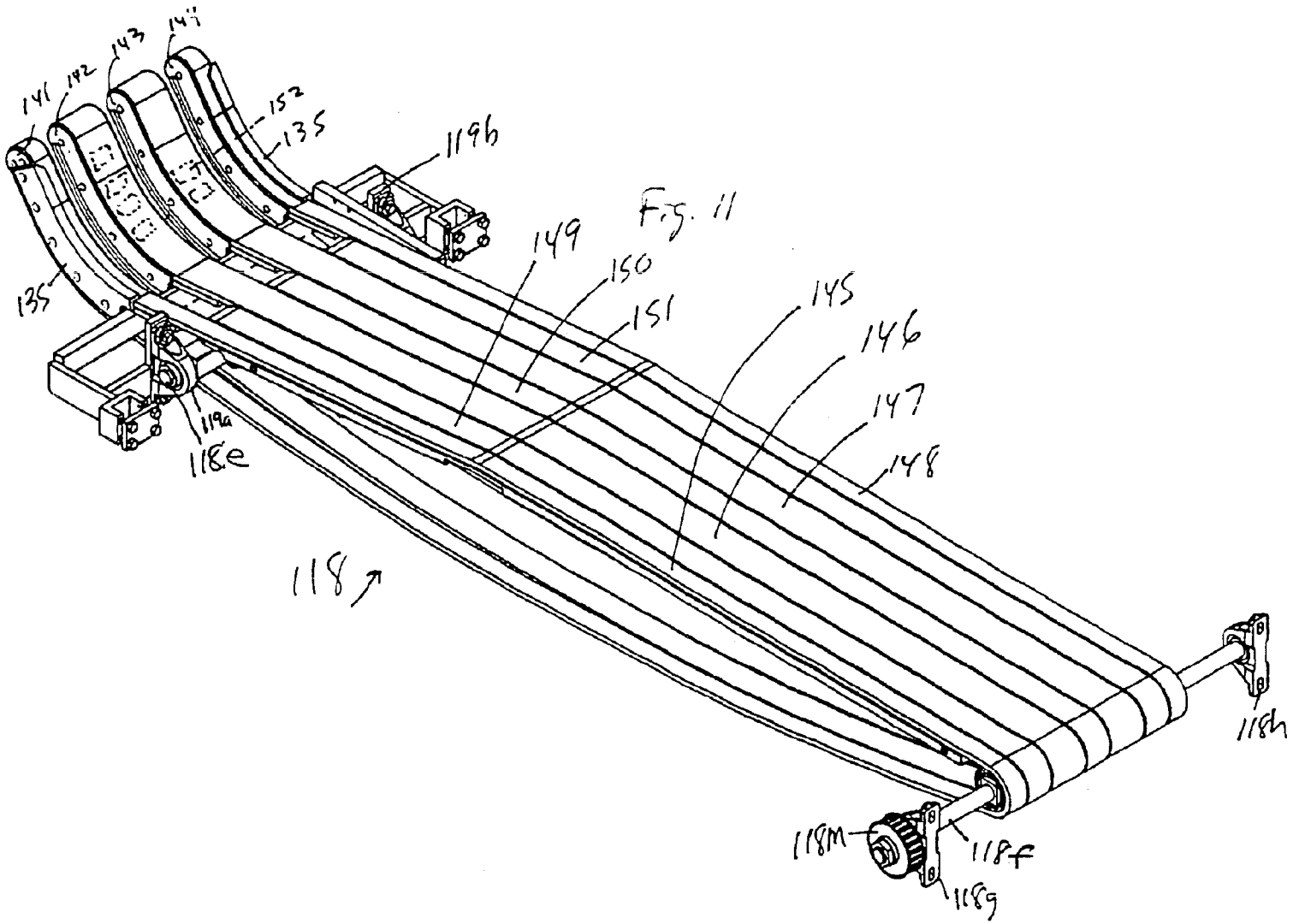

In viewing FIGS. 2, 3, 8 and 11, an empty can conveyor 110 is mounted between two rollers 110*a*, 110*b*. The empty cans move in the direction of the arrow shown with respect to the conveyor 110 in FIG. 2*b*. A return conveyor 112 is mounted at one end between rollers 112*a* and at its other end on its own idler roller on the shaft between the bearings 110*b* and 114*b*, but which are in alignment with rollers 110*b*. The conveyor 112 has its own motor 112*b* and gear box with a speed control that is connected by a belt (not shown) to roller 112*a*. A recycling conveyor 114 is mounted between end rollers 114*a*, 114*b*. Rollers 110*b* and 114*b* are on the same shaft and driven by the same motor 112*b*. Can supply conveyor 116 moves the cans in the direction of the arrow as shown in FIG. 2*a*. A can 300 is moved by diverter arm 201 from the conveyor 110 to the conveyor 116. The conveyor 116 is mounted between two rollers 116*a*, 116*b*. The roller 116*a* is mounted on bearing blocks 116*c*, 116*d* which are in turn suitably mounted to the frame 21. The roller 116*b* is mounted on bearing blocks 116*e*, 117*f* which are also in turn mounted to the frame 21. Finally, a strip-off conveyor 118 is mounted between end rollers 118*e*, 118*f*. Referring now especially to FIG. 11, the strip off conveyor 118 is shown in detail. The end roller 118*f* is mounted on two bearing blocks 118*g*, 118*h* which are suitably mounted to the frame 21. A pulley 118*m* is connected to the end of the roller 118*f* and is connected by a belt 118*n* to pulley 50. The other roller 118*e* is mounted on two bearing blocks 119*a*, 119*b* which are in turn mounted to the frame 21. Four nose rollers 141–144 are at the left end, as viewed in FIG. 11 of four conveyor segments 145–148. The roller 118*f* forms the other end of the conveyor segments 145–148. Positioned between the conveyor segments 145–148 are additional conveyor segments 149–151. These conveyor segments 149–151 are carried between the rollers 118*e*, 118*f*. It can therefore be seen that the strip off conveyor 118 actually comprises seven conveyor segments 145–151. Outer members 135 are secured to the curved portion of conveyor segments 141, 144 to hold the curved shape of the conveyors 145, 148. Not shown are curved plastic members which are mounted by brackets and are on the underneath side of the conveyor segments 146, 147 proximate the curved end to have the conveyor segments 146, 147 hold their curved shape at the left end, as viewed in FIG. 11. The can 300 coming off of the paddle wheel 121 is positioned between the curved segments of the conveyor segments 145, 146. The can coming off of the paddle wheel 122 is positioned between the curved portion of conveyor segments 146, 147. Finally, the can coming off of paddle wheel 123 is positioned between the curved portion of conveyor segments 147, 148. A plurality of magnets 152 are positioned underneath the conveyor segments 145–148 at their curved end to assist in positioning the cans 300 and prevents the cans 300 from tipping as they are being further moved away from the paddle wheels 121–123. The magnets are positioned substantially along the entire length of the curved section of the conveyor segments 145, 148, even though only shown in segments 146, 147.

The can positioning mechanism of the present invention includes a can positioning and supply mechanism generally designated at 120. The mechanism 120 is best seen in FIGS. 1, 7 and 9–10. The mechanism 120 includes a plurality of paddle wheels 121, 122, 123. The construction of the paddle wheels are similar and only one will be discussed in detail. Further, while the invention is shown with three paddle wheels, it is understood that there is one paddle wheel that is used for each line of tamales 200 coming down the conveyor. Therefore, if there is only one line, only one paddle wheel would be necessary. Further, if there were more than three lines, more than three paddle wheels would be utilized. The paddle wheel 121 has an outer periphery on which eight can positioning members 124 are secured. The can positioning members are secured to the paddle wheel 121 by suitable means such as bolts 125. The can positioning members 124 have a curved front wall 124*a* and a curved rear wall 124*b*. The rear wall 124 is raised and prevents a can 300, in the can que from being pushed forward. Two magnets 126 are positioned underneath the top surface of the member 124 and provide for an attraction force to the can 300 to hold it in position. The magnets 126 may be embedded in the members 124 or positioned beneath the members 124, by means well known. The paddle wheels 121–123 are driven by their own respective servo motor 127–129.

A three-piece shaft is used to rotate the paddle wheels 121–123. However, it is understood that the servo motors may be connected to the paddle wheels in any suitable manner to provide the rotation of the paddle wheels. In the present embodiment, servo motor 127 drives pulley 127*a* by means of a belt 127*b*. Servo motor 128 drives pulley 128*a* by belt 128*b* and servo motor 129 drives pulley 129*a* by belt 129*b*. A first shaft 130 is supported by bearing blocks 133, 134, which are operatively connected to the frame 21. The first shaft 130 is rotated by rotation of a pulley 127*a* and controls rotation of paddle wheel 123. A second shaft 131 is coaxially mounted on the first shaft 130 and is rotated by rotational movement of the pulley 128*a* and controls rotation of the paddle wheel 122. A third shaft 132 is coaxially mounted on the second shaft 131 and is rotated by rotational movement of the pulley 129*a* and controls rotation of paddle wheel 121.

Figure 7:
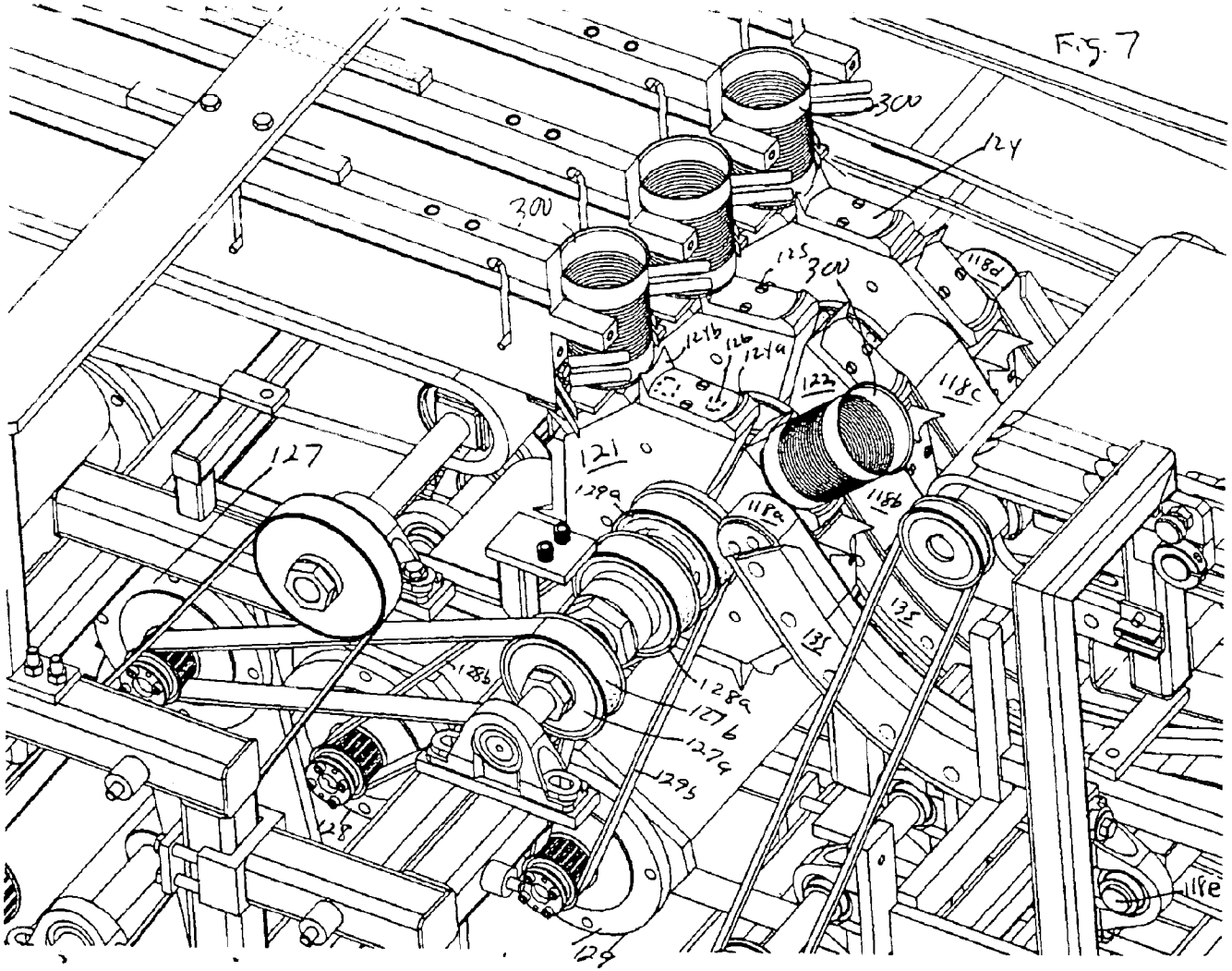
FIG. 7 is an enlarged perspective view of the can handling wheel shown in FIG. 1*a;*
Figure 8A:
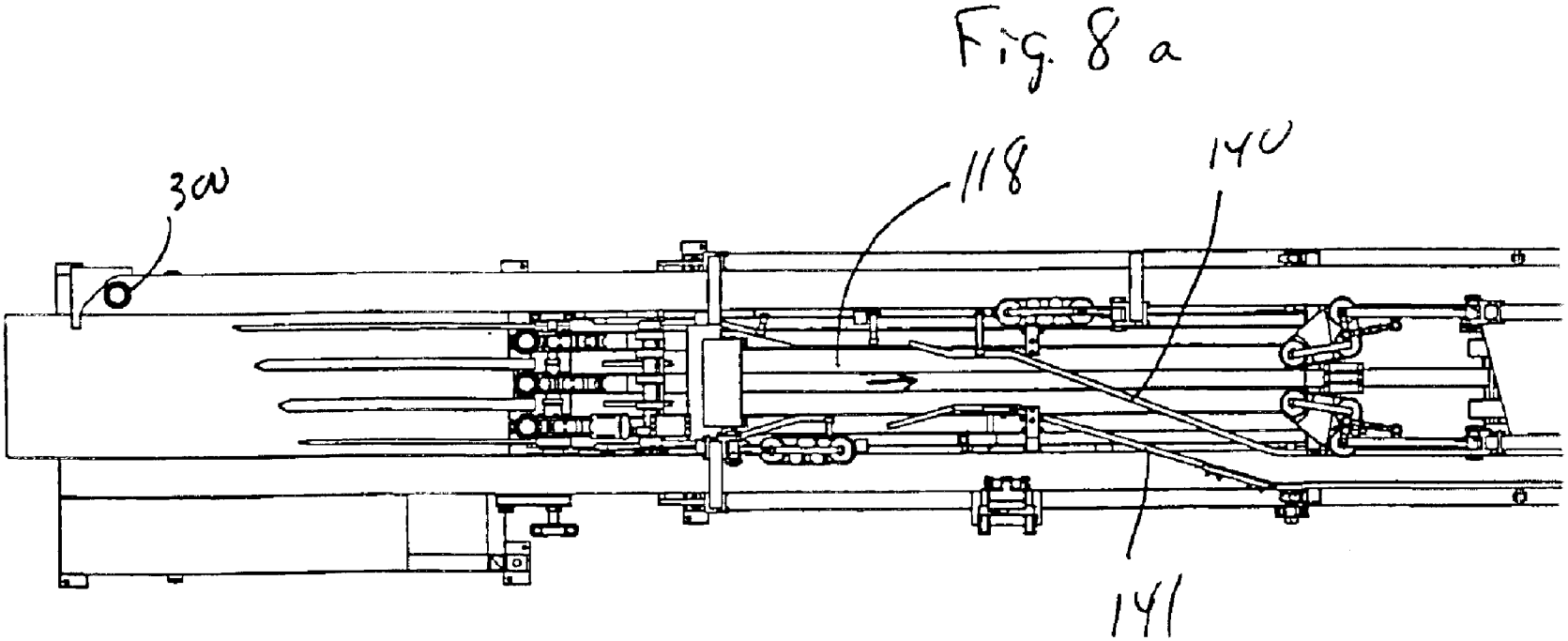
FIGS. 8*a* and 8*b* are top plan views of the apparatus shown in FIGS. 1*a* and 1*b* with the top conveyor and diverter wheels removed.
Figure 8B:
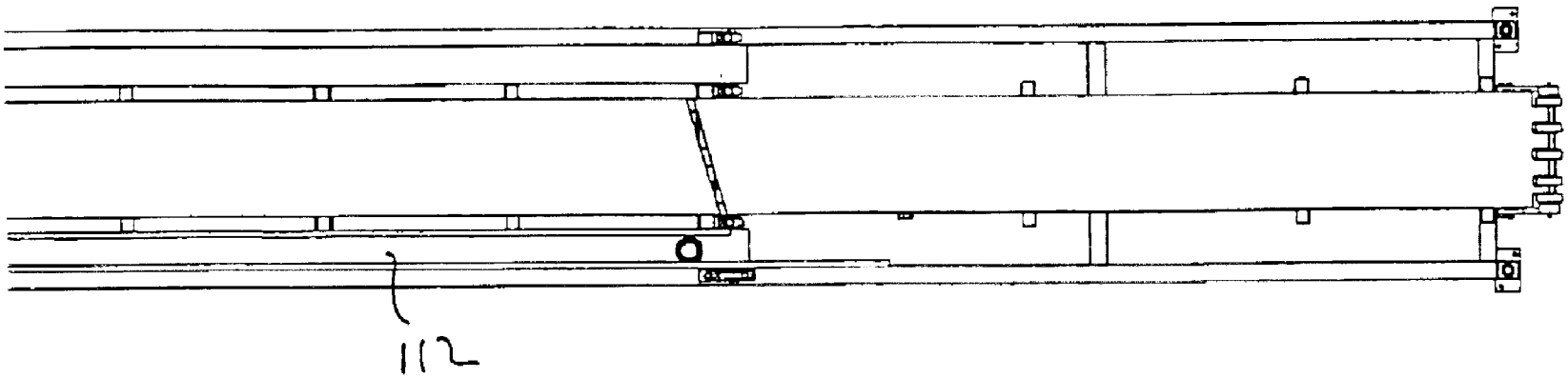
Figure 9:
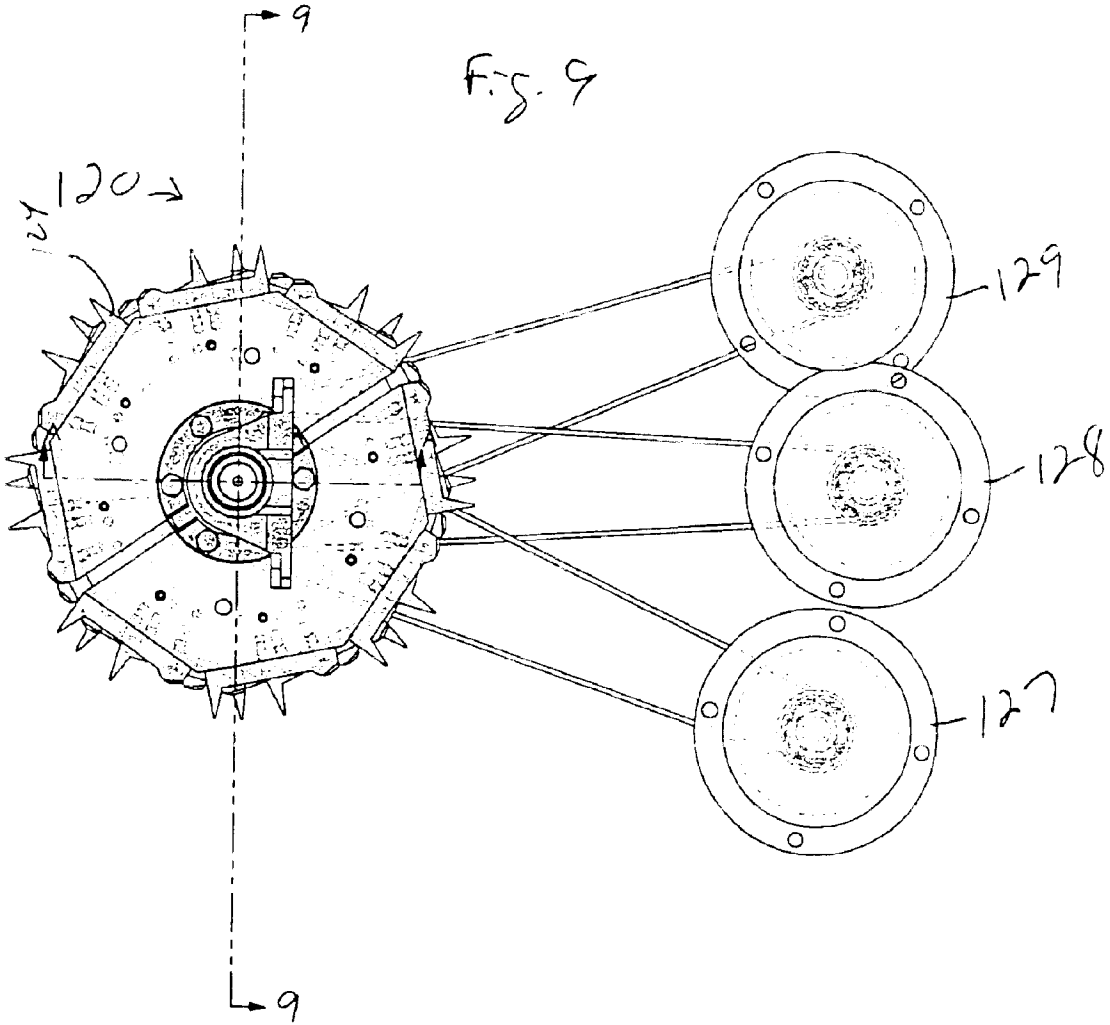
FIG. 9 is a view of the can handling paddle shown in FIG. 1*a;*
Figure 10:
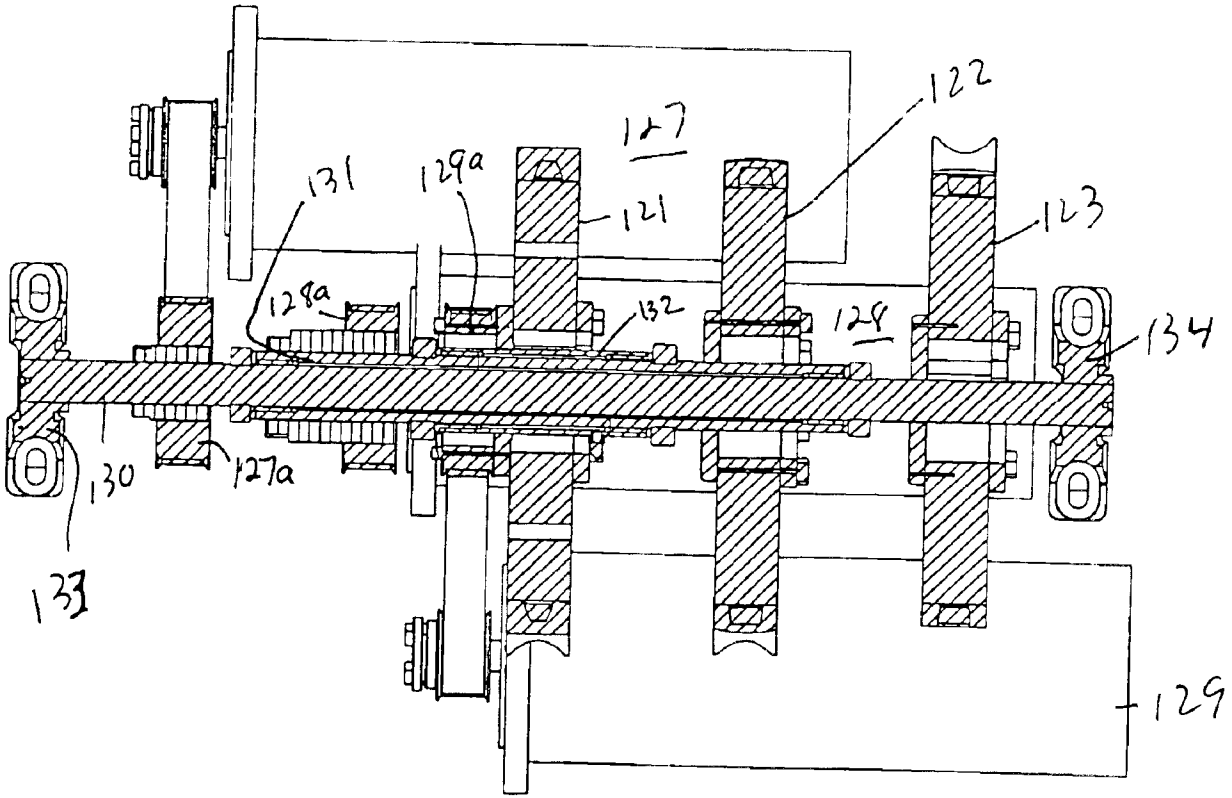
FIG. 10 is a cross-sectional view taken generally along the line 9—9 of the can handling section shown in FIG. 9.

As viewed in FIG. 7, the can 300 that is tilted and shown in the loading position has one side almost resting on the strip-off conveyor 145 and the other side almost on the strip-off conveyor 146. Therefore, as the strip-off conveyor 145, 146 are moved and the loading wheel 121 is indexed, the can 300 will contact the strip off conveyor and will be carried away with the strip off conveyors 145, 146.

The can supply conveyor 16 has three lanes formed which feed the cans 300 to the paddle wheels 121–123. Four dividing members 136–139 are supported over the conveyor 116 to channel the cans 300 to the paddle wheels 121–123. It is understood that any type of channeling or queuing mechanism may be utilized.

In operation, a plurality of tamales 200 are continuously extruded and placed on the first end 23*a* of the conveyor 23.

When they are initially on the conveyor 23, they are typically extruded three across. There is a slight spacing between the tamales at this time. The tamales 200 then pass through a metal detector 59, as is well known in the art. The tamales 200 then approach the converging mechanism 61. At this point, there is still a slight spacing, approximately ⅛ inches between the individual tamales side to side. The three tamales abreast may be referred to as a draft of tamales. The draft of tamales is moving on the conveyor 23 in the direction of the arrows shown in FIG. 2*b*. The converging conveyors 62, 63 are being driven at the same speed as the belt 24, so as to reduce the stress on the tamales as they are moved inward. The distance between the first conveyor 62 and second conveyor 63 upstream is greater than the distance between the conveyors downstream. As can be seen in FIG. 2*a*, the conveyors 62, 63 converge going downstream. The purpose of this is to move the tamales 200 into a tight draft of three tamales so that they are positioned so as to be touching.

As will be described, the present invention is shown as being used for three lanes or lines. The converging mechanism 61 does reposition and converge every draft of tamales going down the belt 24. However, the main function of the converging mechanism 61 is to converge the draft of tamales 200 that are going down the centerline. The drafts of tamales 200 that are going to the right and left sides are acted upon by the diverter wheels 63, 64 which, as will be described more fully hereafter, do also function as a force to converge the draft of tamales into a draft where the adjacent tamales are touching each other.

Figure 6:
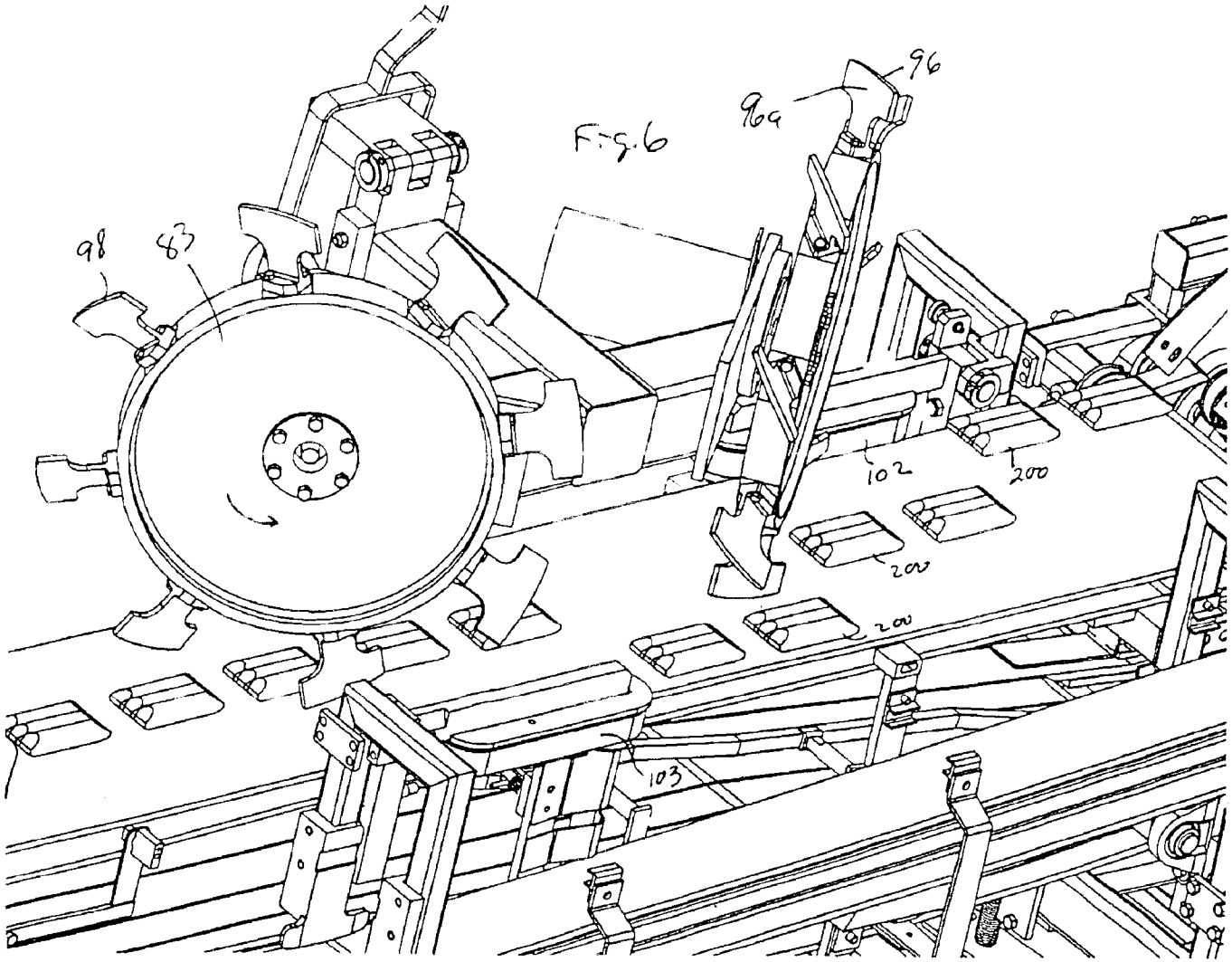
FIG. 6 is an enlarged perspective view of the diverter wheels shown in FIG. 5 taken from the other side of the packaging apparatus.

A photosensor (not shown) is positioned just downstream from the converging mechanism 61. The photosensor detects a draft of tamales and sends a signal to a controller (not shown) which controls the servo motors 92, 93 as well as the servo motors 127–129. The controller will signal for the diverter wheel 83 to be rotated at the appropriate time. This causes a draft of tamales 200 to be moved to the right as seen in FIG. 6. The diverter wheel 83 is at an angle as are the diverter paddles 98. This results in a sweeping motion causing the drafts of tamales to move from the center to the right. The speed of the rotation of the diverter wheel 83 is such that the tamales 200, as they are being moved to the right, are not pushed forward or rearward with respect to the movement of the belt 24. The sweeping motion of the paddles 98 is at an angle to the belt 24 and therefore the motion of the paddles 98 have a horizontal component and a lateral component. The lateral component of the movement will transfer the tamales from the center to the right-hand portion while the horizontal component is matched to the speed of the belt 24 so there is not damage to the tamales as they are moved sideways. This restricts the amount of forces that are placed on the tamales 200. The lateral component of the paddles is equal to the distance the tamales are to be moved to the edge. The longitudinal component substantially matches the speed of the belt 24. As the tamales 200 are moved to the right, the paddles 98 will move the tamales into the conveyor 103. This conveyor 103 provides a stop for the tamales 200 and aligns them laterally at a specific location and orientation so that they are in position to be placed in the cans 300, as will be described more fully hereafter. Again, the speed of the side positioning conveyor belt 103*d* is the same as the belt 24 again to minimize forces on the tamales 200. As previously stated, if the converging section 61 was not utilized on the tamale drafts being moved to the right by diverter wheel 83, the movement of the diverter wheel 83 and paddles 98 would compress the draft tamales 200 into a side-by-side arrangement. That is, the movement would act as a converging mechanism, the same as converging mechanism 61, if the function had not already been performed by a converging mechanism 61. The diverter wheel 83 is cycled twice so as to cause two drafts of tamales to be positioned behind each other on the right, as shown in FIG. 6. Then, at the appropriate time, the diverter wheel 84 is similarly operated to move the draft of tamales 200 off to the left, as viewed in FIG. 6. Similarly, the diverter paddles 96 will move the draft of tamales lateral to the left into the side conveyor 103 which functions the same as side conveyor 102. Also, at the appropriate time, the diverter wheels are not actuated so that two drafts of tamales 200 are still going down the center of the belt 24 and are in alignment with the output of the converging mechanism 61. FIG. 6 shows two drafts of tamales to the left, two drafts of tamales in the center and two drafts of tamales to the right. The three lanes of drafts are now filled up and ready to approach the can positioning and supply mechanism 120. The three lanes have been precisely laterally aligned to be fed into the cans 300 on the paddle wheels 121–123.

The paddle wheels have been utilized to divert the tamales to the right or left side of the conveyor. It is also understood that a reciprocating motion could also be utilized such as the actuation of an air cylinder having a tamale engaging member on its end. Again, it would be preferable that this reciprocating motion would be at an angle to the belt 24 so that there would be a horizontal component of motion that would be equal to the speed of the belt 24.

A supply of cans 300 is provided by placing the empty cans 300 on the conveyor 110. The cans 300 then travel until they hit the diverter arm 201 where they are moved to the can supply conveyor 116. The cans 300 then queue into one of three lanes defined by the dividing members 136–139. Any cans that are not placed into the queues formed by the divider members will move to the bottom, as viewed in FIG. 2*a*. They would then be moved on conveyor 112 to the right until they hit a stop arm 153, shown only in FIG. 1*a*. The stop arm is positioned just prior to the end of the conveyor 114 and the stop arm would move the cans on to the conveyor 114 where the cans 300 would be recycled back to the can supply conveyor 116. It is understood that any other suitable means of queuing the cans to the three lanes leading up to the paddle wheels 121–123 may be utilized. Various controls are only shown in FIGS. 1*a* and 1*b* and are not shown in the other views. It is understood that these controls, or other suitable controls, known to one skilled in the art, may be used.

Proceeding now with the description of the tamales as they are moved into the cans 300, and referring now, especially to FIG. 7, there is shown one can 300 in an inclined position on paddle wheel 121. The other cans are not shown in position, however, it is understood that there would also be a can in the inclined position on paddle wheels 122, 123. Further, there would be cans in position on the can positioning members 124 behind the inclined cans 300. The tamales are approximately 4⅛ inches long and there is a space of approximately 2 inches between the drafts of tamales. Each draft of tamale, consisting of three tamales, is approximately 2½ inches in width. The can 300 has an opening with a diameter of 2⅞ inches. The inclined can, as shown in FIG. 7, is in the receiving position. The tamales are moved along the belt 24 at a speed of approximately 44 inches per second and this speed is sufficient to fly the draft of tamales off of the belt 24 and into the can 300. The speed, spacing and orientation of the can 300 and tamales 200 are such that the draft of tamales 300 fly into the can on a trajectory that inserts them slightly above the horizontal centerline of the can opening. The tamales hit the bottom of the can then immediately fall downward and the next draft of tamales, 2 inches behind, is flown into the can at the same position, slightly above the horizontal centerline of the can. Even at a spacing of 1 inch between drafts, and at the speed noted above, there is still sufficient time for the first draft of tamales to fall down in the can before the second draft enters. Six tamales are then in the can and it is ready to be removed for further processing. This further processing would include adding the sauce and the top to the can, such processing being well known in the art.

As previously discussed, a controller will control the movement of the paddle wheels 121–123 to provide a can in the receiving position. The rotation of the paddle wheels by the servo motors has been previously described and will not be described in more detail. As the paddle wheels rotate, the rear wall 124*b* is rotated forward allowing the next can 300 to be positioned on the can positioning member 124. The magnets will assist in holding the can in the correct position as it is being loaded. The can is then indexed to the receiving position. Then, after the tamales have been loaded, the can paddle wheel will rotate and the can 300 will be stripped away from the paddle wheel as it is moved on top of conveyors 145, 146. This will bring the can down and away from the paddle wheel along the arc of the curved sections 145, 149. The conveyor 145, 149 then moves the cans on to the takeaway conveyor which includes the four strip-off conveyors 145–149 and additional conveyors 149–151 that are placed between the segments of the strip-off conveyors 145–149 to form a flat take-away conveyor. The cans are then moved between positioning arms 140, 141 to move the cans, as viewed in FIG. 8, downward and on to the return conveyor 112 where they are then subsequently removed for further processing.

While the flying of the tamales into the cans on the paddle wheel 121 have been described, it is understood that the tamales are similarly flown into the cans on the paddle wheels 122, 123. The controller controls the appropriate movement of the paddle wheels to coincide with the draft of tamales which have been detected by the photosensor further upstream. The diverter wheels and converging mechanism has aligned the three lanes of tamales to match the three cans 300 on the three paddle wheels 121–123.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for positioning frangible objects on a moving conveyor, from a first position to a second position, comprising:

a) a conveyor having a conveyor belt for carrying the frangible objects, the conveyor belt having a centerline;

b) a first rotatable wheel mounted above the conveyor belt, the wheel having a plurality of pushing paddles attached to the wheel at spaced intervals, the wheel having an axis which is at an angle to the centerline of the conveyor belt; and c) a stop member positioned laterally to the frangible objects when in the first position, wherein rotation of the wheel over the moving conveyor causes the paddles to contact the frangible objects at the first position and move the frangible objects laterally as the frangible objects continue travelling on the conveyor to contact the stop member, thereby moving the frangible objects to the second position.

2. The apparatus of claim 1, wherein the wheel is at an angle of 40 degrees to the centerline of the conveyor.

3. The apparatus of claim 2, further comprising a second rotatable wheel having a plurality of pushing paddles attached to the wheel at spaced intervals, the second wheel having an axis at an angle to the centerline of the conveyor belt, wherein the pushing paddles of the first rotatable wheel move the frangible objects to one side of the conveyor and the pushing paddles of the second rotatable wheel moves the frangible objects to another side of the conveyor.

4. The apparatus of claim 1, wherein the frangible objects are tamales.

5. The apparatus of claim 4, further comprising a converging mechanism, the converging mechanism having a first side and a second side, the first and second sides being separated at a first distance upstream and a second distance downstream, the second distance less than the first distance, wherein multiple frangible objects passing through the converging mechanism are moved closer together.

* * * * *